US007556700B2

(12) United States Patent
Boisvert

(10) Patent No.: US 7,556,700 B2
(45) Date of Patent: Jul. 7, 2009

(54) ICE SKATE BLADE PRODUCED BY PULSE PLASMA NITRIDING

(75) Inventor: Marc Boisvert, 315 Pierre Fontaine, Boisbriand Québec (CA) S7G 1Y1

(73) Assignee: Marc Boisvert, Rosemère (CA)

( * ) Notice: Subject to any disclaimer, the term of this patent is extended or adjusted under 35 U.S.C. 154(b) by 186 days.

(21) Appl. No.: 11/025,226

(22) Filed: Dec. 29, 2004

(65) Prior Publication Data

US 2005/0139290 A1 Jun. 30, 2005

(30) Foreign Application Priority Data

Dec. 31, 2003 (CA) ..... 2455891

(51) Int. Cl.
*C23C 8/26* (2006.01)

(52) U.S. Cl. ..... 148/318; 148/222

(58) Field of Classification Search ..... 148/319, 148/318, 222; 427/430.1

See application file for complete search history.

(56) References Cited

U.S. PATENT DOCUMENTS 6,458,220 B1 * 10/2002 Kuehmann et al. ..... 148/319

FOREIGN PATENT DOCUMENTS

CA 2036477 8/1992
CA 2410835 12/2003
CA 2455891 5/2004
JP 2002317225 A * 10/2002

OTHER PUBLICATIONS

Pye, David, "Practical Nitriding and Ferritic Nitrocarburizing," ASM International, pp. xi-xii, 14-15, 31-35, 71-73, 80-86, 167-169, 177, 245-246 (2003).

Totten, George E., Ed., "Steel Heat Treatment: Metallurgy and Technologies," CRC Press, pp. 476-478, 487-488, 493-496, 499, 506-507, 513-514, 517-522 (2006).

* cited by examiner

*Primary Examiner*—George Wyszomierski
*Assistant Examiner*—Weiping Zhu
(74) *Attorney, Agent, or Firm*—Goudreau Gage Dubuc

(57) ABSTRACT

A process to manufacture ice skate blades and the ice skate blades that result from this process where the blades of made from a nitridable steel hardened to a medium hardness (Rockwell C 38-55) then nitrides by a plasma nitriding process disclosed which prevents hardness loss in the steel while adding very hard nitride layer of a thickness in excess of 50 microns that gradually drops to the base steel hardness. The plasma nitriding process control is enhances dy addition of an intert gas and by the pulsing of the plasma field on and off for millisecond periods to prevent overheating of the ice skate blade during processing.

9 Claims, 7 Drawing Sheets

Section A - A

Section A - A

Section A - A

ICE SKATE BLADE PRODUCED BY PULSE PLASMA NITRIDING

FIELD OF THE INVENTION

This invention shows a method of making an improved ice skate blade by a process of plasma nitriding and the blade created from that process.

SUMMARY

An ice skate blade with improved wear properties is formed by plasma nitriding processes where the base hardness of Rockwell C 38 to 55 is maintained while a self supporting nitride rich zone is created by plasma nitriding. The process is enhanced if the plasma field used in the nitriding is pulsed to add temperature control to the process.

BACKGROUND AND PRIOR ART

Ice skates provide a narrow band of contact between each foot and the ice. The area of contact with the ice is ideally small such that the ice is melted by the pressure and this miniscule water layer adds to the slip of the skate contact area over an ice surface. The small area in contact with the melt by itself would be counterproductive since unlimited slip would also provide no control over direction or speed. A second element is needed, at least one element which can penetrate the water layer and act upon the solid ice to provide for directional changes, acceleration force or braking force. In normal ice skates the bottom, at one time a flat narrow band of steel, is now a concave strip of steel in contact with the ice with the long edges along a blade and a ground away center between these edges of the ice skate blade providing for a water cushion between two sharp edges that easily contact solid ice.

In practice the skate blade requirements are highly conflicted. The projecting edges must be very hard because, contrary to intuition, ice is very abrasive. If the edges are not hard, wear rapidly decreases the "bite" of the edges into the solid ice. There is also a contrary need for flexibility of the blade. Hardness is generally associated with stiff non-flexible materials while very easily flexed materials are usually soft and deformable. Forces transverse to the long axis of the blade during acceleration or braking where the edges bite into the ice at an angle normal to the direction of travel place extreme shear forces upon the blade. Since hard materials tend to be brittle the shear forces easily break hard blades. A delicate balance is needed to obtain a hard edged blade which will not break in use.

One way to measure the hardness of a steel blade is by using the well known Rockwell C scale of hardness. This used an indenter to measure and provide a numerical value representing the resistance of the steel to the penetration of a steel indenter which is easily related to hardness. A very hard alloy steel can be 65 RockwellC while untreated hot rolled steel is at 20 Rockwell C. The 65 Rockwell materials, despite the best alloying effects are just plain brittle. A thin strip of this hard a steel will be shattered by a sharp impact. A thin strip of hot rolled steel will merely deform if impacted. Clearly an ideal skate blade would have outside edges along the length of the blade that were close to 65 Rockwell C scale with a center of 20 Rockwell C. There could be several ways to make a blade with a softer center and a hard edge. As noted below, all prior blades that attempted this had serious drawbacks to the hard edge, soft center blade concept. While Rockwell C scale is used throughout in this discussion, the actual measurements of the hardness of the nitrided portions of the skate blade were performed by cutting slices of the blade normal to the flat surface and close to the ice contact surface and measuring these cut and polished surfaces with a microindenter. The microindenter provides Vickers scale results which were converted into the more frequently used Rockwell C scale numbers using an ASTM issued conversion chart.

A first logical method of making an ideal blade is used in Swedish knife manufacture where a hard layer is coupled or bonded to a soft layer. Problem not solved since the hard layer is very brittle and a hard layer backed by a softer layer acts like a very thin glass microscope slide placed on a warm stick of butter. The least pressure normal to the slide surface will shatter it since there is no reinforcement for the brittle glass material. The same thing happens when soft steel and hard steel is combined (although it does work better if the hard material is in the center like the knives). This type blade would have broken edges which would grab the solid ice and ruin control. Additional problems are differential expansion which can warp the blade and the problems of bonding the layers in a long strip without distorting the strip.

If composites do not work, then selective hardening should provide an ideal result. Steels can be surface hardened with heat application. Unfortunately, thin strip heats too fast to provide a softer center with a hard surface. The steels tend to thru harden. The blade is then uniformly brittle or uniformly soft.

Other treatments are also well known. Ancient swords were hot hammered with carbon or boron and folded many times and again beaten flat to form a multi layered structure where microscopic layers of soft and hard provided strength, hardness and flex. This worked on a microscopic scale but a macro ($1/8^{th}$ inch) thickness with just a hard outside and soft center was not obtainable with this method.

Nitriding involves the addition of nitrogen diffused in steel which then precipitates into very hard particles within the steel. Aside from the warping that is caused when the steel has granules added within the structure, the nitrogen diffusion takes place at temperatures that soften steel and the layers are under 8 microns thick so we rapidly get back to brittle thin layers over soft metal—the butter and glass problem revisited.

At the present time, skate blades are through hardened to a Rockwell 40 to Rockwell 55 hardness. This is a compromise where the blade never breaks (at R-C 40) or only once in a while breaks (at R-C 55). The blades need frequent sharpening—to the extent that in Hockey games or competition as many as twice a game/competition. Performance drops as the blade edges start to dull. Sharp edges often are the difference between a win and a loss in the high levels of competition common today.

There are no really useful blades that reliably stay sharp and do not break. The ideal of a hard outer and a flexible soft inner layer may not be possible but new technology allows a reasonable inner layer hardness (Rockwell C 48-50) with gradually increasing hardness within a nitrided layer that ends in hardness well in excess of Rockwell C 65 at the outer (ice contact) edge.

DESCRIPTION OF THE INVENTION

Nitrided surfaces remain intriguing if problems of depth of nitride layer, brittleness and hardness of the backing layer can all be solved. The invention shown a product and method of manufacture that solves the need for hard outer surfaces in a skate blade with no breakage of the blade. The above stated ideal of a soft center in still not usable but a very hard edge upon a medium hard center is obtainable and provides a skate that outlasts a normal blade by a actor of 10 times of more.

Nitrided surfaces have superb hardness integral with the steel substrate/base that they coexist with. Since the nitriding is not a coating but integral in the steel structure it is a lasting and impossible to remove part of the steel surface. The hardness is actually a product of the diffusion of nitrogen atoms into the steel and the subsequent formation of very hard iron nitrides at the boundaries of crystallites within the steel.

Normally nitriding results in a very thin and very hard layer. Because elevated temperatures are used to form the nitrides, the surfaces often distort and the high temperatures result in a soft base for the thin but hard nitride portion of the surface. The temperatures of 800 to 1100 degrees C. that are used in processing of nitrided parts result in Rockwell 30 or less body hardness of parts. The nitriding on such a soft base easily breaks. While subsequent hardening can be done, such hardening creates severe warpage in thin parts and if grinding is used to restore flatness the nitride layer is ground away.

The plasma nitriding process uses a very different approach to diffusing nitrogen within a solid steel matrix. Unlike the bath process where nitrogen containing hot salt baths are used to rapidly diffuse nitrogen into the steel matrix or the enriched atmosphere furnaces where nitrogen is again freely supplied to the heated steel matrix, the very low pressures and the partial nitrogen content of the atmosphere, molecules hitting the surface of the steel are counted in the hundreds (vs the millions at ambient pressures) and allow the nitrogen to slowly diffuse into the steel and to be transported deep into the steel matrix without forming saturated layers at the surface of the steel. A key feature is to diffuse the nitrogen into the steel as fast as it enters the steel matrix so no saturation occurs. In recent tests, it has been conclusively shown that the saturation of the surface with nitrogen acts as a barrier to further transport of nitrogen across the solid/gas interface. This saturation is the factor that effectively ruins normal nitriding of skate blades since the resulting nitride layer is too thin to be effective, especially since the temperatures involved also soften the steel so the hard layer has no backing that helps prevent fracture of the hard portions.

The vacuum based plasma nitriding process enhances the transport of low levels of the nitrogen within the furnace gas in both the intergranular transport and the intragranular transport of nitrogen atoms. As the two transport mechanisms become approximately equal, and as long as the amount of transport is such that the nitrogen is well below the saturation point, the transport continues without the iron nitride particles of formations blocking further passage of nitrogen atoms. This results in the slow but very deep penetration of nitrogen into the steel matrix. The resulting nitride content thus becomes a thick layer, at least 10 times the thickness common with bath nitride processes.

The invention provides a thick transitional layer of a decreasing nitrogen content as function of distance from the exposed surfaces of the parts. This results in a hardness profile that also decreases from very hard to the base metal hardness. By control of temperatures at which the nitriding takes place, a long term heat cycle can be set where the substrate hardness is not changed yet nitriding takes place. The soft center of RockwellC 20 is not beneficial but using the blade hardness known to not break as the base hardness and building the effective edge hardness in a manner that supports the hardest part without breakage of the hard layer or the skate blede, considerable improvement in performance can be made.

PREFERRED EMBODIMENTS

Figure 1:
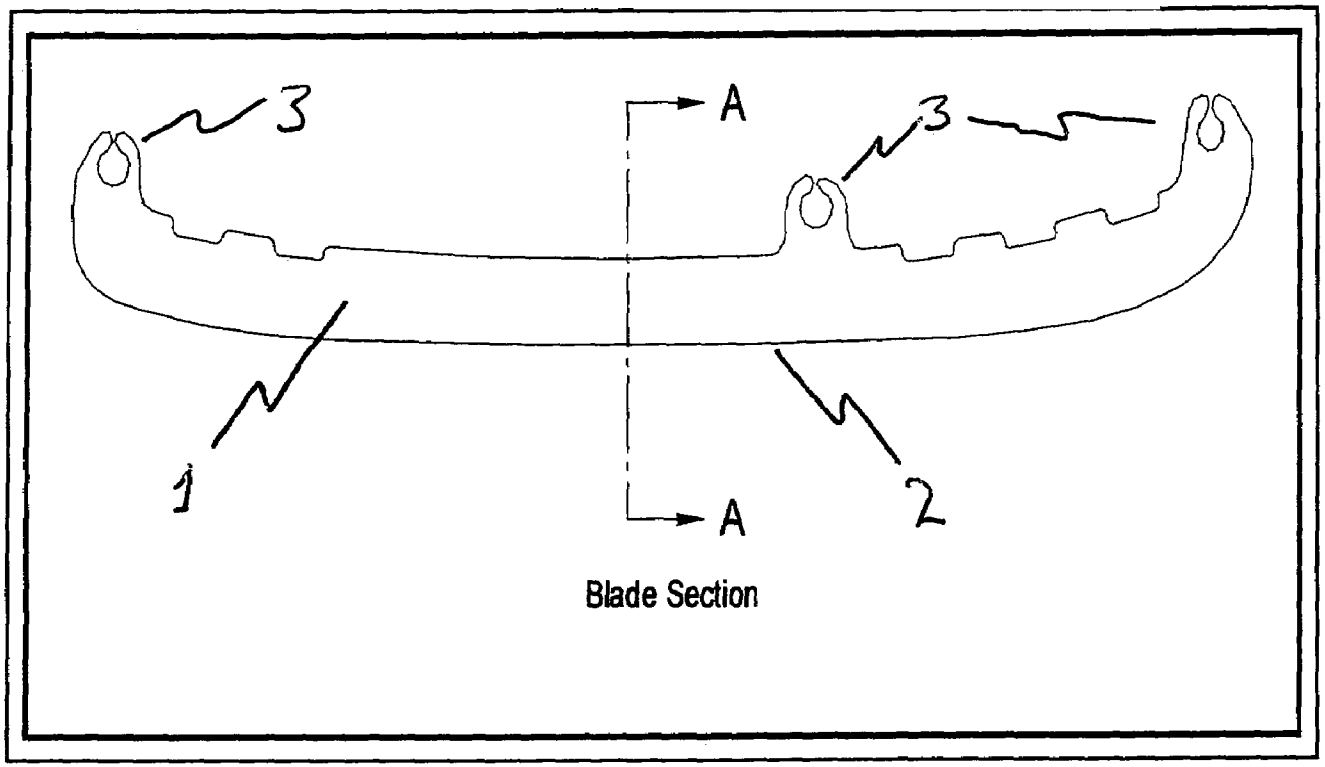
In FIG. 1 a typical ice skate blade configuration is shown as 1. The blade has a ice contact surface which is cut to concave at the bottom, 2. Attachment means are shown as 3.
Figure 2:
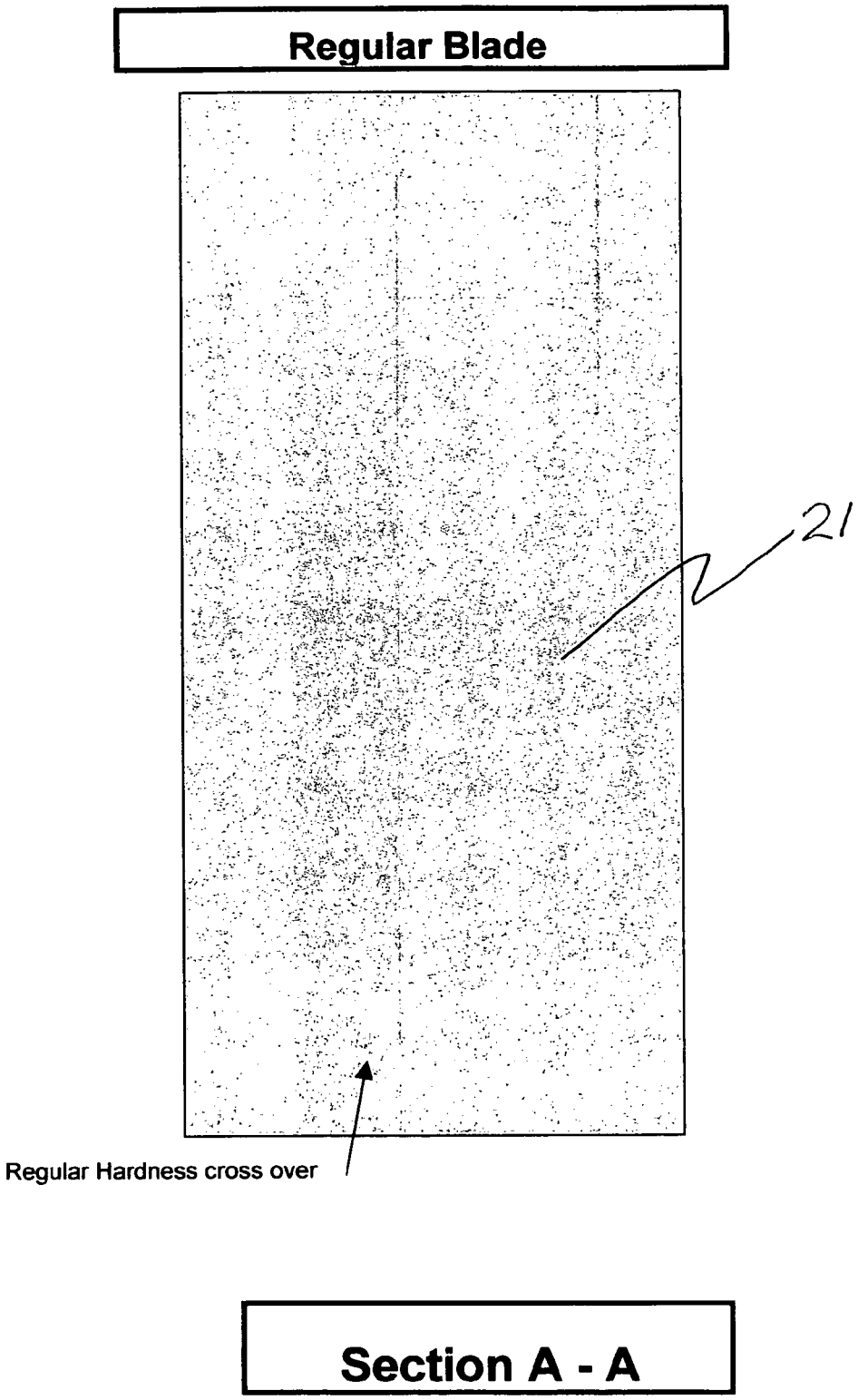
In FIG. 2 showing the cross section at A-A of FIG. 1 the hardness is visually shown for a typical blade 21 as now sold.
Figure 3:
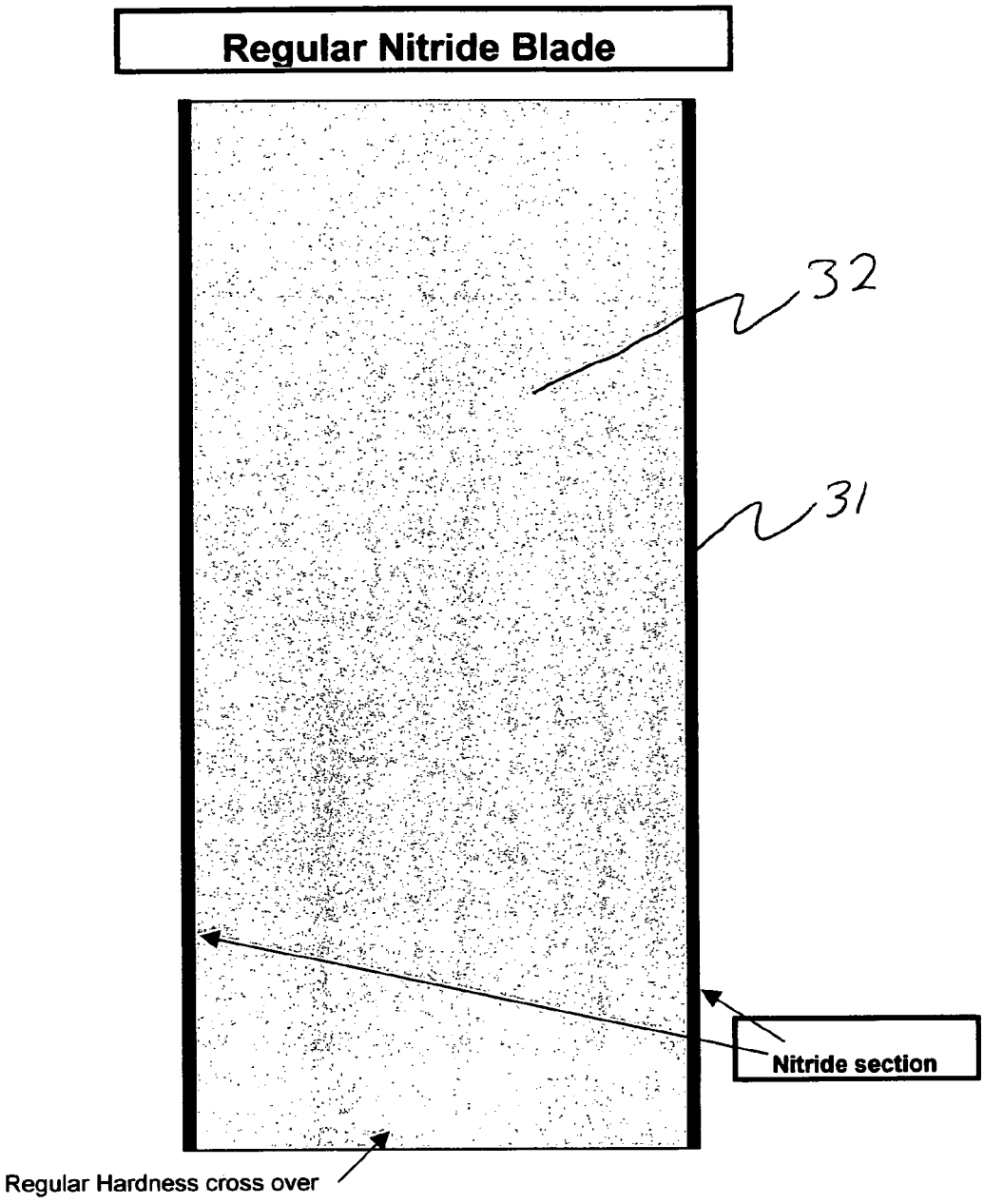
In FIG. 3 a blade with a normal nitride layer 31 is shown visually charted on the base hard center portion 32.
Figure 4:
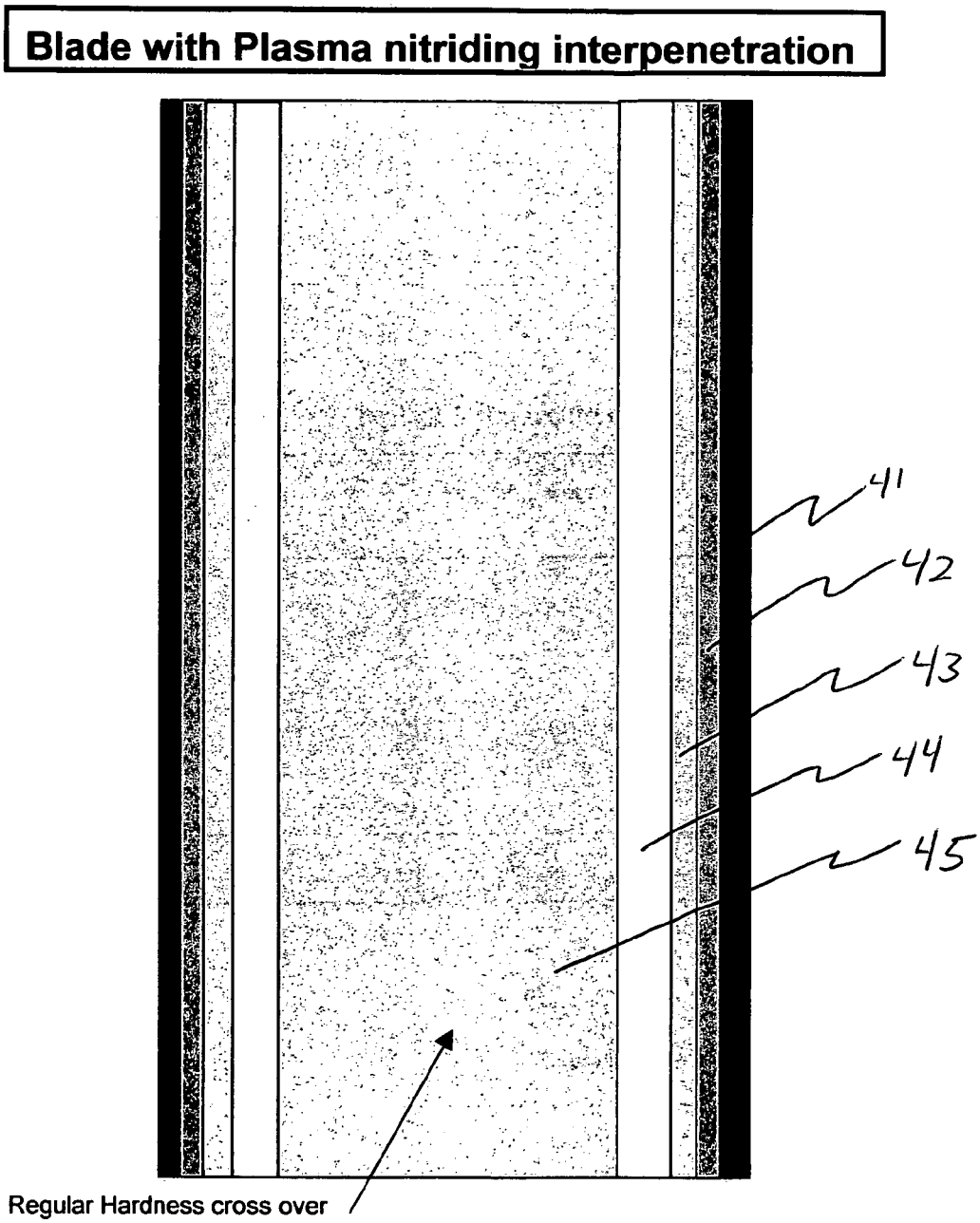
In FIG. 4 the cross section A-A of a blade is shown graphically with a thick nitride layer 41 next to a layer where diffusion has resulted in slightly less nitride content 42 and where a third lesser nitride content layer supporting layers 41 and 42 is shown as 43 and a thicker layer 44 where the nitride content tapers to the level of the base metal 45.
Figure 5:
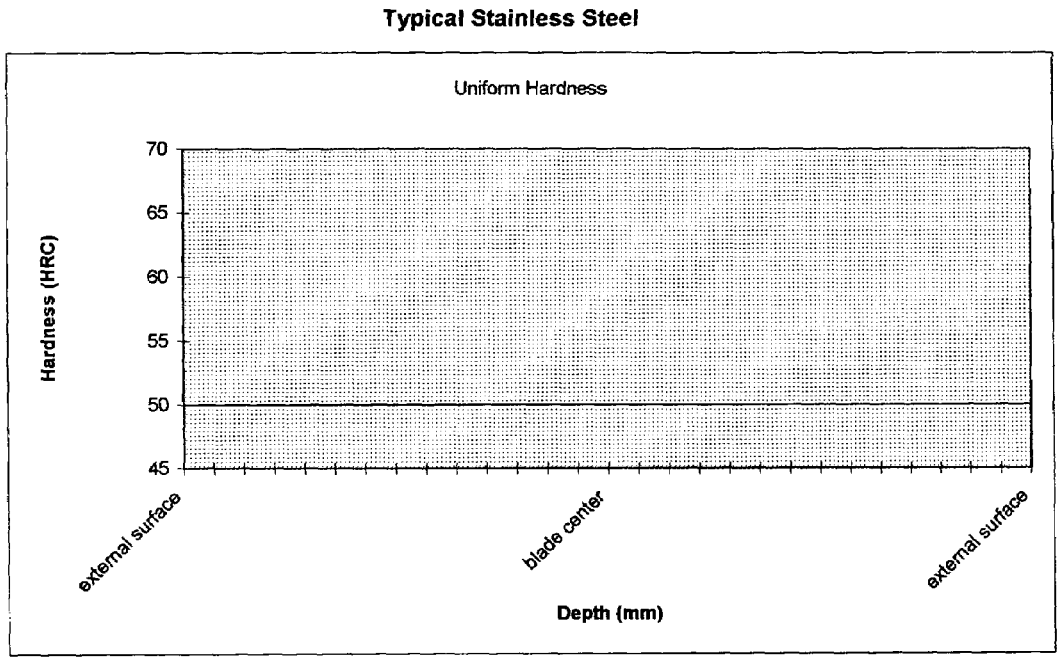
In FIG. 5 actual hardness data on a medium hard skate blade is shown across the total width of the blade In FIG. 6 simulated hardness data for a blade made with nitride layers by present technology without affecting the center hardness (center would actually be softer).
Figure 6:
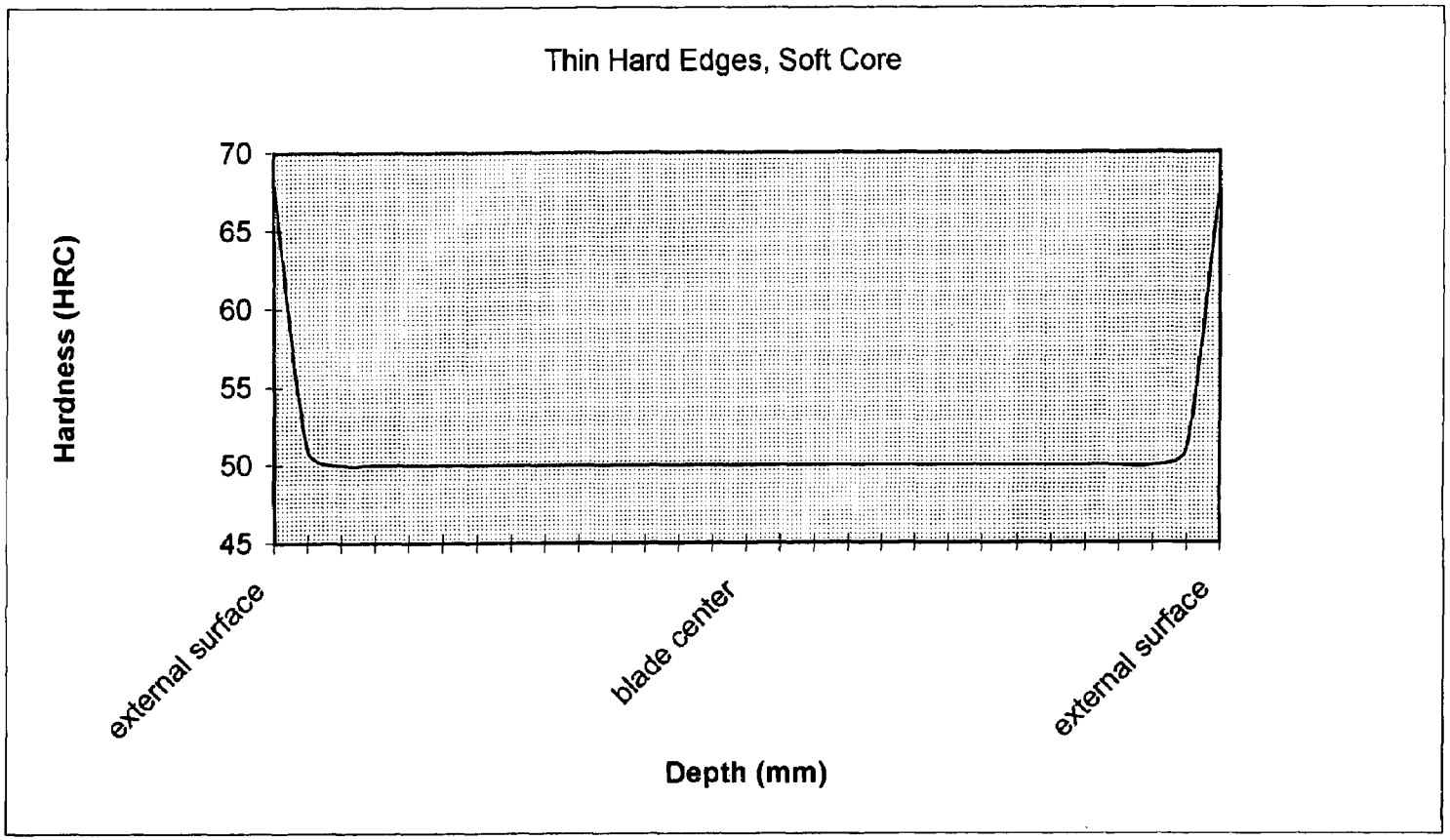
Figure 7:
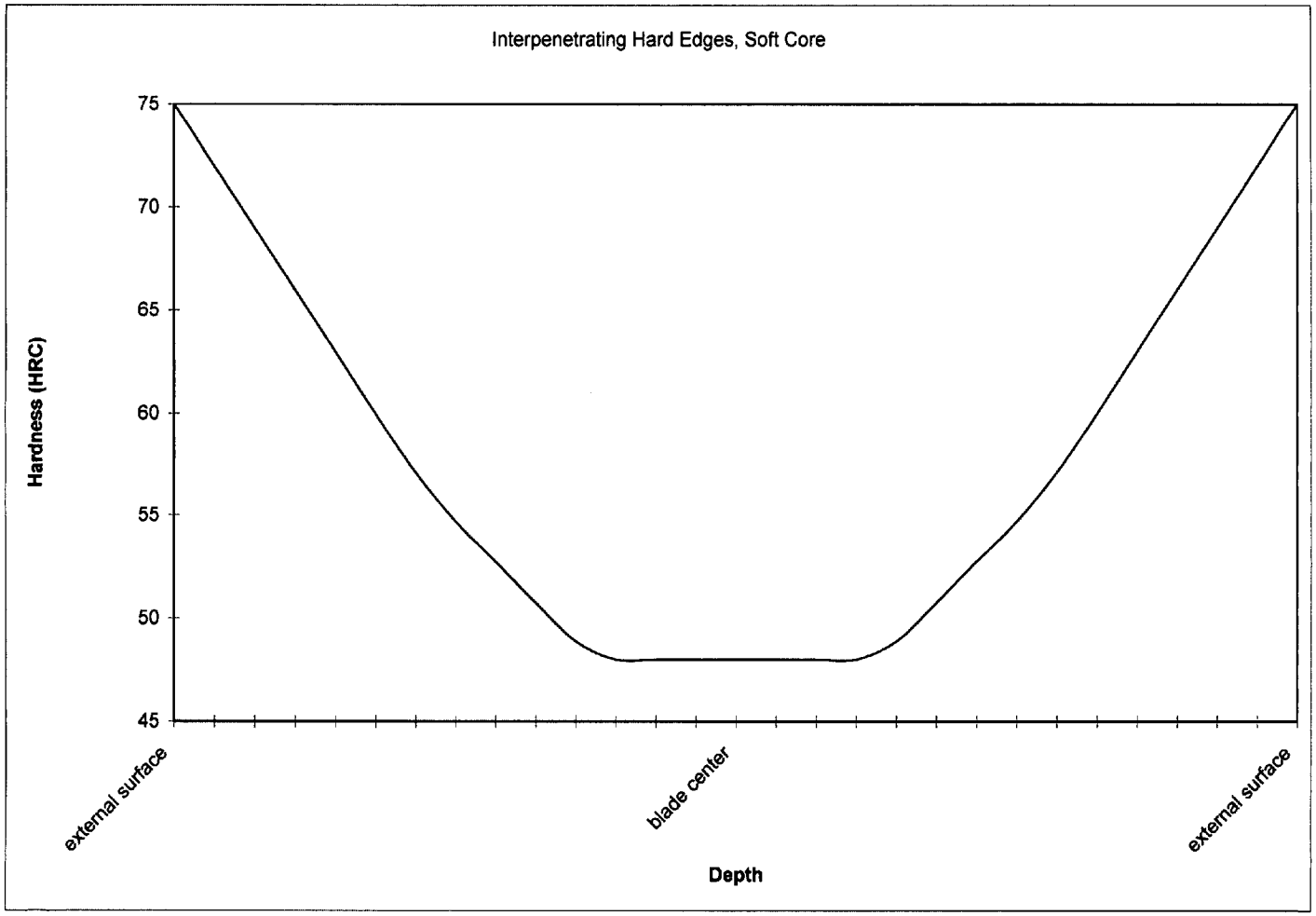
In FIG. 7 actual data on a skate blade cross section A-A is shown with a hardedge and the hardness tapering towards the base hardness at the center.

In the most preferred embodiment a D2 type steel is selected and cut by laser or other common forming methods to the configuration of a skate blade. The bottom surface that will be in contact with the ice has sufficient extra metal to permit grinding the final contour into this surface and the flat surfaces are 0.005 inches greater that the finished skate thickness.

The cut blade is then through hardened to Rockwell C-48 hardness by conventional controlled atmosphere furnace hardening methods. Following the hardening a preliminary grind restores flatness and removes material with a +0.0005 excess retained in the blade. The blade is carefully cleaned with solvents.

The clean blade is mounted on a carrying rack designed to provide a high loading factor in the furnace. In this case the surface that will contact the ice is faced outward towards the furnace outside walls and the vertically arranged blade is aligned in a radial plane from the center of the furnace vertical axis.

The furnace is evacuated to a vacuum in excess of 10 exp −4 torr and an atmosphere of hydrogen with no nitrogen is introduced. In the first, a cleaning stage, argon and carbon dioxide is also introduced in trace amounts. The carbon dioxide prevents removal of carbon in the steel while the argon acts as an enhancing agent in the surface bombardment of the parts being nitrided or cleaned. External heating may be used to raise temperatures to no more than 500 degrees C. then, still at vacuum, a electronic plasma is generated within the furnace with the walls of the furnace attracting the particular materials on the parts being nitrided and these particles being stripped from the parts. This reverse field has proven very effective in cleaning of parts. Following a 30 minute to 90 minute cleaning cycle, the furnace is purged of the carbon dioxide and argon and a new mixture consisting of hydrogen carrier gas with low levels of nitrogen and optional argon is introduced into the furnace. The nitrogen levels are empirically determined such that there will be no saturation of the steel parts with nitrogen—this is basically ⅓$^{rd}$ or less of the stochiometric amounts of nitrogen required in normal nitriding processes.

The temperature of the furnace is raised to near 600 degrees C. and with the low nitrogen in hydrogen a plasma field is generated in the normal manner directing the gas molecules towards the parts and racking. The process requires long times for the nitrogen to diffuse into the steel at amounts that are lower than the saturation level. This means each molecule must diffuse away from the part surface before another molecule is absorbed. The temperature is controlled to maintain temperatures that do not destroy the through hardness of the parts (in the 45-55 Rockwell C range). The furnace process requires 20 to 36 hours of treatment, the time and power being empirically determined based upon furnace power supply and configuration. The temperature limit of 700 degrees C. requires a long time for diffusion into and within the steel.

At the completion of the cycle, nitrogen levels may be increased to saturate and gain extra hardness at the part surface, then the parts are cooled in a neutral gas atmosphere gradually introduced until atmospheric pressures are attained.

The cooled parts are removed and finish ground to remove the very slight warping, if any of the parts and to provide a pleasing appearance to the part—a finished skate blade. The bottom, ice contact surface may be pre ground or ground when the skate is mounted upon a ice skate.

In a second embodiment, the plasma field used to activate the nitrogen is a pulsed field where a plasma is formed around the parts and then collapsed for a short time, the field on and field off times being in microseconds. The heating effect of the plasma is thus on only part time. This allows the better control of temperatures and since low temperatures are required, this greatly adds to the overall control of the process.

In a third embodiment between 0.5 and 8% argon is added to the gas flowing through the furnace which further activates the part surface by bombardment by this high mass atomic weight gas molecule, speeding the process and assisting in nitrogen diffusion.

In a fourth embodiment other steels which have a chromium content below 8% and which are nitridable steels are utilized for the parts.

I claim:

1. A steel ice skate blade, having two sides, the ice skate blade comprising:

a first part of a substantially constant first hardness about a center plane of the blade and sandwiched between a pair of opposed second parts;

each of said pair of second parts of between about 50 and 200 microns thickness and of an increasing hardness that varies gradually between said first part and an outer surface on each side of the blade from said first hardness to a second hardness greater than said first hardness wherein the blade is manufactured from a stainless steel alloy having a chromium content of greater than 10%.

2. The steel ice skate blade according to claim 1 wherein a hardness of said first part lies between 46 to 52 Rockwell C, inclusively.

3. The steel ice skate blade according to claim 1 wherein said second hardness at an outer surface of each of said pair of second parts lies between about 65 Rockwell C and 75Rockwell C.

4. The steel ice skate blade of claim 1, further comprising a nitrogen rich zone of between 50 and 200 microns on and into each of said two sides wherein said nitrogen rich zone gradually increases a hardness of said two sides and further wherein said hardness is greatest on an outer surface of each of said two sides and decreases gradually towards said core.

5. The steel ice skate blade of claim 1, wherein the blade has a tempered first hardness of between Rockwell C-38 to C-55.

6. A steel ice skate blade, having two sides, the ice skate blade comprising:

a first part of a substantially constant first hardness about a center plane of the blade and sandwiched between a pair of opposed second parts;

each of said pair of second parts of between about 50 and 200 microns thickness and of an increasing hardness that varies gradually between said first Dart and an outer surface on each side of the blade from said first hardness to a second hardness greater than said first hardness and wherein the blade is manufactured from a steel alloy comprising only trace amounts of Cobalt (Co).

7. A steel ice skate blade, having two sides, the ice skate blade comprising:

a first part of a substantially constant first hardness about a center plane of the blade and sandwiched between a pair of opposed second parts;

each of said pair of second Darts of between about 50 and 200 microns thickness and of an increasing hardness that varies gradually between said first part and an outer surface on each side of the blade from said first hardness to a second hardness greater than said first hardness and wherein the blade is manufactured from a steel alloy comprising a carbon content of greater than 0.25%.

8. A nitrided steel ice skate blade manufactured from a stainless steel alloy sheet material having a core sandwiched between a pair of second parts, a chromium content of greater than 10% , a carbon content of greater than 0.25% and a tempered first hardness of between Rockwell C-38to C-55 and further comprising a nitrogen rich zone of a depth of between 50 and 200 microns on and into said pair of opposed second parts of said material and wherein a hardness of each of said pair of second parts gradually increases across said nitrogen rich zone from said first hardness at said core to at least about 65 Rockwell C at an outer edge of each of said pair of second parts.

9. The nitrided steel ice skate blade of claim 8, wherein said nitridable steel strip or sheet material consists of D2 type steel.

* * * * *

UNITED STATES PATENT AND TRADEMARK OFFICE

CERTIFICATE OF CORRECTION

PATENT NO. : 7,556,700 B2
APPLICATION NO. : 11/025226
DATED : July 7, 2009
INVENTOR(S) : Marc Boisvert It is certified that error appears in the above-identified patent and that said Letters Patent is hereby corrected as shown below:

In claim 6, column 6, line 24, change "Dart" to --part--.

In claim 7, column 6, line 34, change "Darts" to --parts--.

Signed and Sealed this

First Day of September, 2009

David J. Kappos

David J. Kappos
*Director of the United States Patent and Trademark Office*